US009884668B2

(12) United States Patent
Richter

(10) Patent No.: US 9,884,668 B2
(45) Date of Patent: Feb. 6, 2018

(54) ANCHOR CRADLE FOR HANDLING AND STOWING FLUKE, RETURN BAR-TYPE ANCHORS

(71) Applicant: James Rayohl Richter, Plymouth, WI (US)

(72) Inventor: James Rayohl Richter, Plymouth, WI (US)

( * ) Notice: Subject to any disclaimer, the term of this patent is extended or adjusted under 35 U.S.C. 154(b) by 0 days.

(21) Appl. No.: 15/233,759

(22) Filed: Aug. 10, 2016

(65) Prior Publication Data

US 2017/0043841 A1 Feb. 16, 2017

Related U.S. Application Data

(60) Provisional application No. 62/203,153, filed on Aug. 10, 2015.

(51) Int. Cl.
*B63B 21/22* (2006.01)

(52) U.S. Cl.
CPC ..... *B63B 21/22* (2013.01)

(58) Field of Classification Search
CPC ..... B63B 21/22; B63B 21/20; B63B 21/18; B63B 21/16
USPC ..... 114/210
See application file for complete search history.

(56) References Cited

U.S. PATENT DOCUMENTS 2,931,331 A * 4/1960 Uebelhoer ..... B63B 21/22 114/210
3,595,194 A * 7/1971 Wolff ..... B63B 21/22 114/210
3,752,107 A * 8/1973 Van Tuyl ..... B63B 21/22 114/210
3,865,065 A * 2/1975 Dennis ..... B63B 21/22 114/210
4,057,025 A * 11/1977 Piotrowski ..... B63B 21/22 114/210
4,248,171 A * 2/1981 Barbour ..... B63B 21/22 114/210
4,526,123 A * 7/1985 van den Haak ..... B63B 21/22 114/210
4,528,929 A * 7/1985 Await, Jr. ..... B63B 21/22 114/210
4,556,007 A * 12/1985 Await, Jr. ..... B63B 21/22 114/210
4,616,589 A * 10/1986 Adams ..... B63B 21/22 114/210

(Continued)

*Primary Examiner* — Anthony D Wiest

(57) ABSTRACT

An anchor cradle for fluke, return bar-type anchors which provides an efficient means for handling and stowing said anchors. The cradle includes a first support bracket and a second support bracket, wherein each comprises a base plate, a wing plate, and a nose plate. The base plate for both the first support bracket and the second support bracket are mounted parallel and offset to each other and each are pivotably mounted to an arm of a boat winch. The wing plate interlocks with the flukes of the anchor and is adjacently connected along a top edge of the base plate. The wing plate for both the first support bracket and the second support bracket are oriented away from each other in order to create an anchor-receiving region. The nose plate reorients the anchor and is adjacently connected along a front edge of the base plate, forming a triangular-shaped nose portion.

15 Claims, 5 Drawing Sheets

(56) References Cited

U.S. PATENT DOCUMENTS 5,996,524 A * 12/1999 Johnson ..... B63B 21/22
114/210
6,843,196 B1 * 1/2005 Richardson ..... B63B 21/22
114/210

* cited by examiner

ANCHOR CRADLE FOR HANDLING AND STOWING FLUKE, RETURN BAR-TYPE ANCHORS

The current application claims a priority to the U.S. Provisional Patent application Ser. No. 62/203,153 filed on Aug. 10, 2015.

FIELD OF THE INVENTION

The present invention relates generally to a cradle for a fluke, return bar-type anchor, otherwise known as a Richter anchor. More specifically, the present invention is a cradle for a Richter anchor that prevents the anchor from dislodging from a winch assembly and potentially causing damage to a watercraft. The cradle is designed to securely hold the flukes of the anchor in place as well.

BACKGROUND OF THE INVENTION

In order to prevent a watercraft from drifting due to water current or wind, a device known as an anchor is commonly deployed into the water. Temporary anchors are often deployable and retractable from a watercraft and in shallow water are generally deployed into the bed of the body of water. Modern anchors such as the Richter anchor feature teeth-like extrusions referred to as "flukes" that facilitate fastening the anchor to the bed of a body of water. When an anchor is not deployed into the water, the anchor is typically secured to the watercraft in some way, most often within a cradle attached to the deployment and retraction arm of a winch. The anchor is deployed and retracted into the water via an anchor line that is attached to the anchor and tethered to the watercraft. Return bar-type anchors feature a return bar that is secured to the anchor line and facilitates retrieval of the anchor. A common problem encountered with return bar-type anchors such as the Richter anchor is the tendency for an anchor to exit the water and slide onto the cradle via the return bar only. This places the anchor into a highly unstable position within the cradle and greatly increases the chances of the anchor dislodging from the cradle and potentially damaging the watercraft. The present invention seeks to address the aforementioned issues relating to anchor stability during retrieval as well as provide the user with a straightforward, practical, and convenient solution.

The present invention is a cradle for a fluke, return bar-type anchor such as the Richter anchor that greatly increases the stability of the anchor upon coming into contact with the cradle during anchor retrieval. The present invention engages and locks the flukes of the anchor, thus preventing any unwanted movement from the anchor during storage.

DETAIL DESCRIPTIONS OF THE INVENTION

All illustrations of the drawings are for the purpose of describing selected versions of the present invention and are not intended to limit the scope of the present invention.

Figure 4:
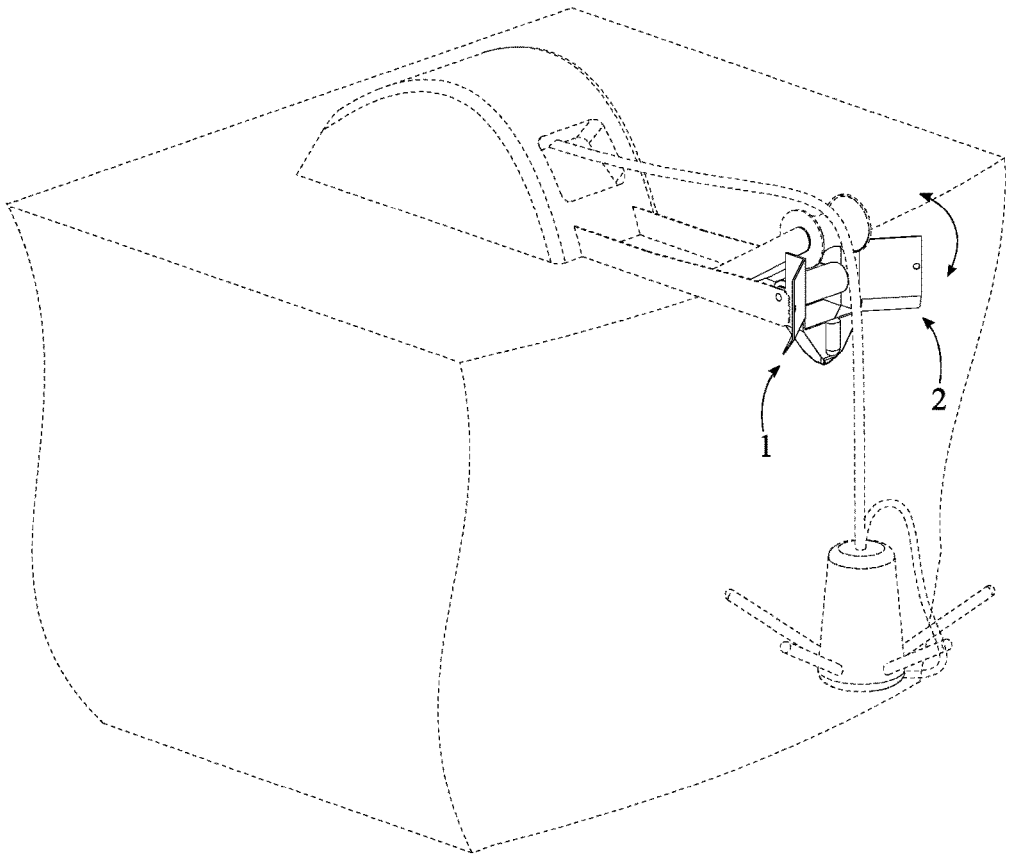
FIG. 4 is a perspective view of the present invention mounted to an arm of a boat winch with an anchor being disposed below the arm.
Figure 5:
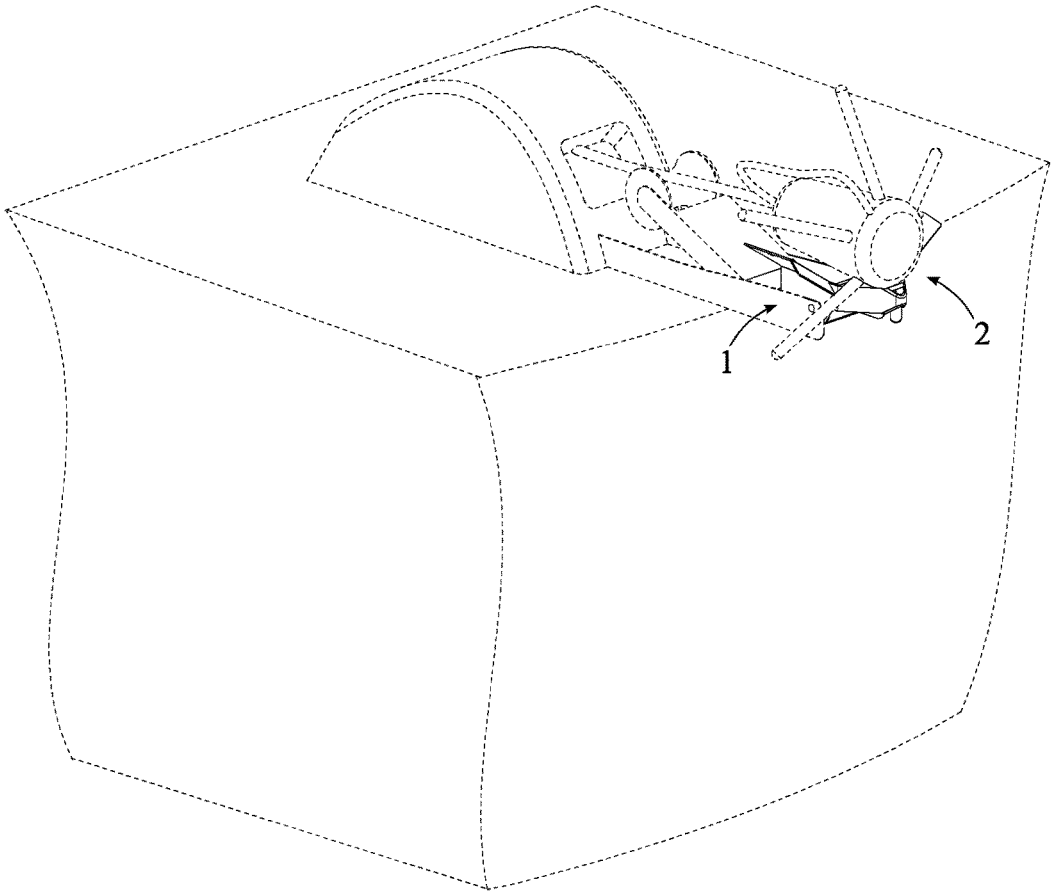
FIG. 5 is a perspective view of the present invention mounted to the arm of the boat winch with the anchor being securely positioned within the present invention.

The present invention is a cradle for fluke, return bar-type anchors such as a Richter anchor. A Richter anchor comprises a cylindrical body portion and a plurality of flukes. The cylindrical body provides the mass for the anchor. The plurality of flukes is radially connected to the cylindrical body portion and facilitate the process of embedding the anchor into the bed of a body of water. The Richter anchor further comprises a return bar that protrudes from the cylindrical body and is attachable to an anchor line. The return bar greatly facilitates the retrieval process from the bed of a body of water in which the anchor is embedded. The object of the present invention is to increase the stability of a fluke, return bar-type anchor during retrieval from the bed of a body of water as well as to hold the anchor in a stable position once the anchor has been retrieved. Referring to FIG. 4 and FIG. 5, the present invention is designed to be rotatably mounted to an arm of a boat winch such that during the retrieving process the anchor engages and locks into the present invention.

Figure 1:
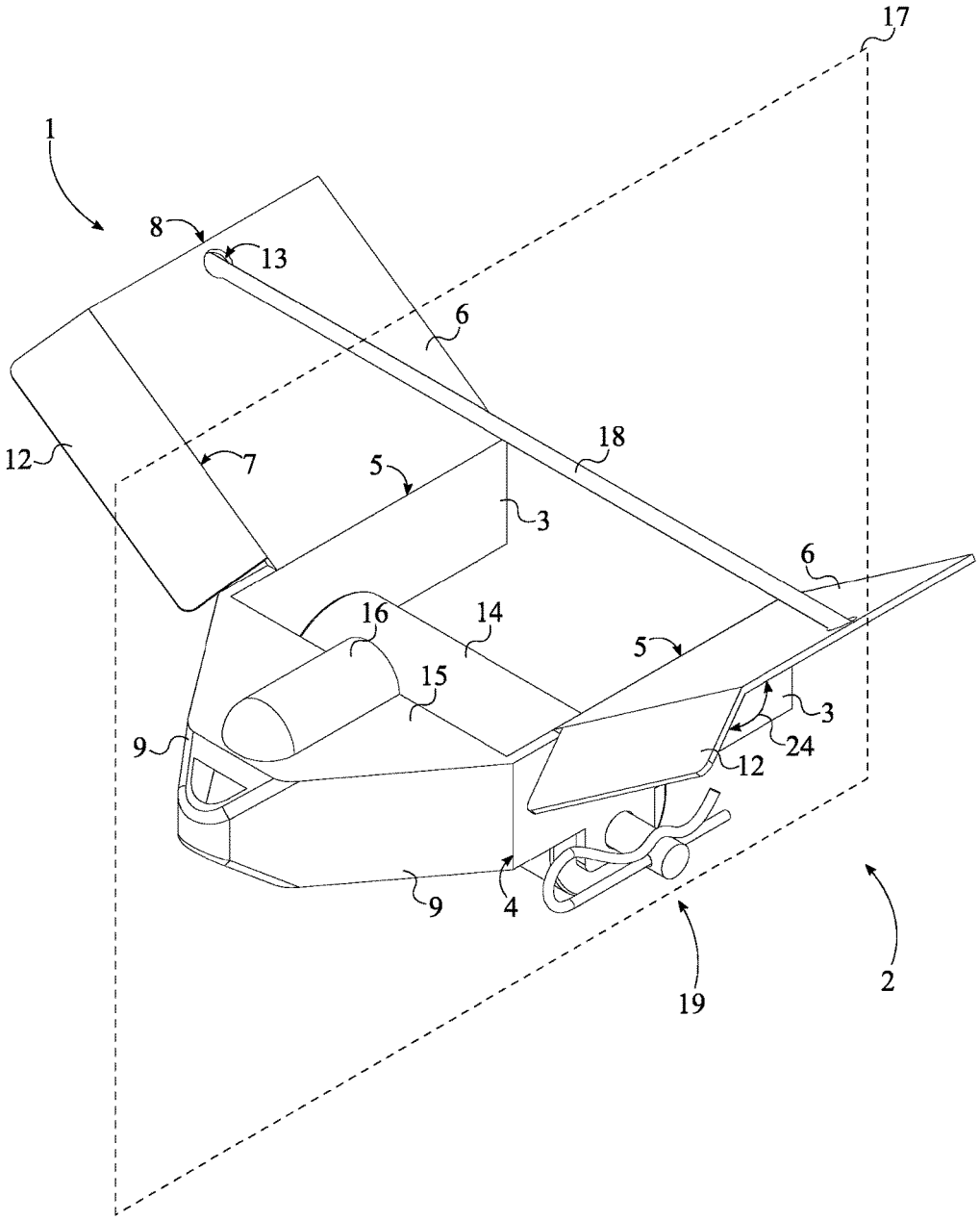
FIG. 1 is a perspective view of the present invention.

Referring to FIG. 1, the present invention comprises a first support bracket 1, a second support bracket 2, a spool 14, a connecting web 15, and a clevis 19. The first support bracket 1 and the second support bracket 2 are identical in design and are used to reorient and receive the anchor. The first support bracket 1 and the second support bracket 2 each comprise a base plate 3, a wing plate 6, and a nose plate 9. The base plate 3 attaches to the boat winch and provides support for the wing plate 6 and the nose plate 9. As such, the base plate 3 of the first support bracket 1 and the base plate 3 of the second support bracket 2 are mounted parallel and offset to each other to create a rail-type base as well as a receiving space for the cylindrical body of the anchor. The wing plate 6 receives and interlocks with one or more of the flukes of the anchor in order to configure the anchor into a locked state within the present invention. The wing plate 6 is adjacently connected to the base plate 3 along a top edge 5 of the base plate 3. Additionally, the wing plate 6 is oriented at a first obtuse angle 10 with the base plate 3. The wing plate 6 of the first support bracket 1 and the wing plate 6 of the second support bracket 2 are oriented away from each other in order to create an open V-shaped structure. The space in between the wing plate 6 of the first support bracket 1 and the wing plate 6 of the second support bracket 2 receives and supports the majority of the anchor.

Figure 2:
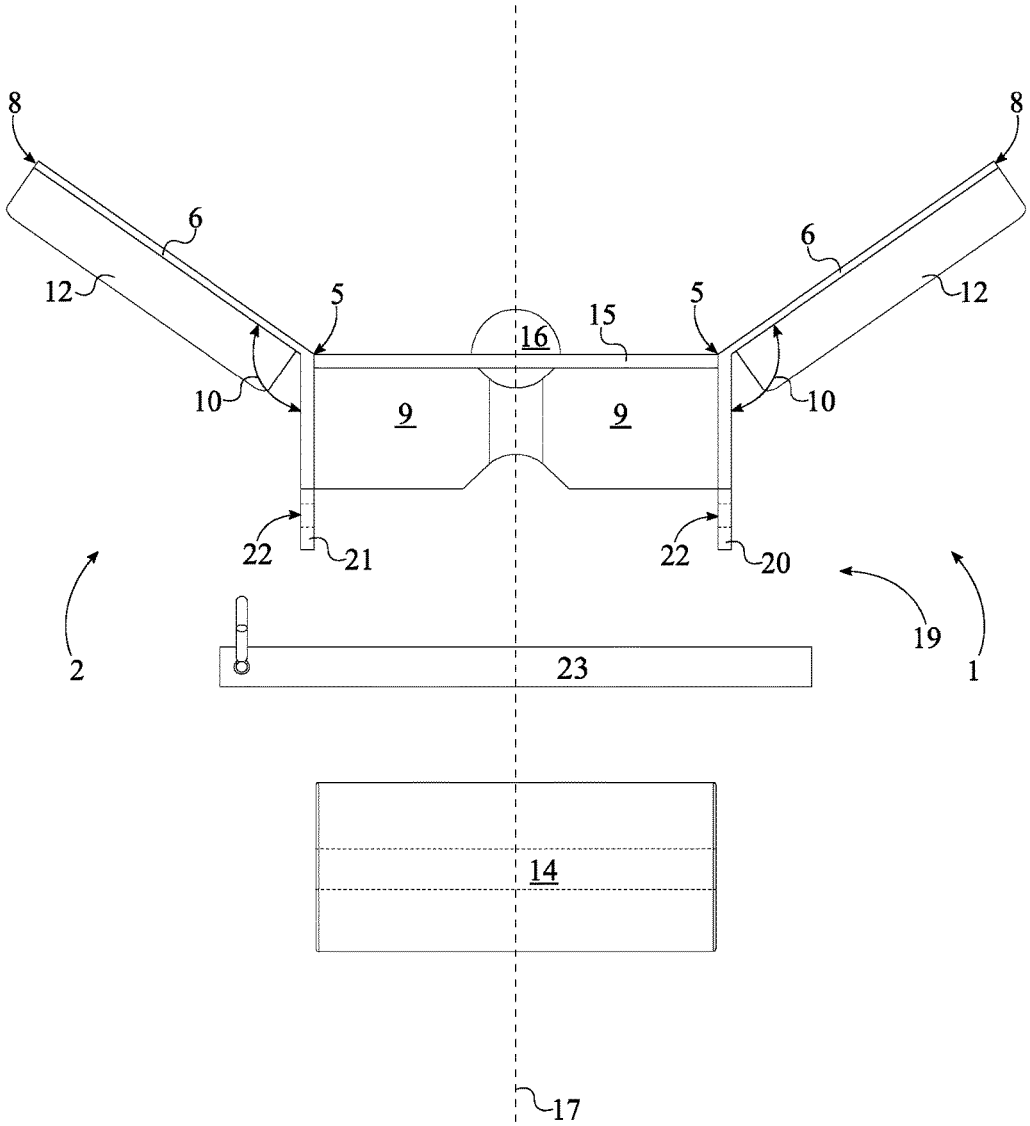
FIG. 2 is a rear exploded view of the present invention.

The nose plate 9 serves as the first point of contact for the anchor during the retrieval process in order to orient the anchor appropriately. The nose plate 9 is adjacently connected to the base plate 3 along a front edge 4 of the base plate 3. The nose plate 9 is oriented at a second obtuse angle 11 with the base plate 3 in order to orient the nose plate 9 away from the base plate 3. The nose plate 9 of the first support bracket 1 and the nose plate 9 of the second support bracket 2 are oriented towards each other as seen in FIG. 2. Additionally, the nose plate 9 of the first support bracket 1 is adjacently connected to the nose plate 9 of the second support bracket 2 in order to create a triangular-shaped nose portion. The triangular-shaped nose portion serves to rotate the anchor prior to engaging the flukes with the wing plate 6 by pushing the return bar of the anchor towards either the first support bracket 1 or the second support bracket 2. This prevents the anchor from resting on the return bar while being secured by the present invention; this is an unstable state for the anchor and can potentially cause the anchor to dislodge from the present invention and damage the watercraft.

The connecting web 15 laterally joins the nose plate 9 of the first support bracket 1 and the nose plate 9 of the second support bracket 2 for increased structural stability. The connecting web 15 is preferably a triangular plate that is connected in between the nose plate 9 of the first support bracket 1 and the nose plate 9 of the second support bracket 2. The thickness of the connecting web 15 may vary to yield a higher safety factor for the present invention. The first support bracket 1, the second support bracket 2, and the connecting web 15 are preferably composed of a durable and rust-resistant metal in order to withstand the forces associated with supporting and retaining marine anchors.

Figure 3:
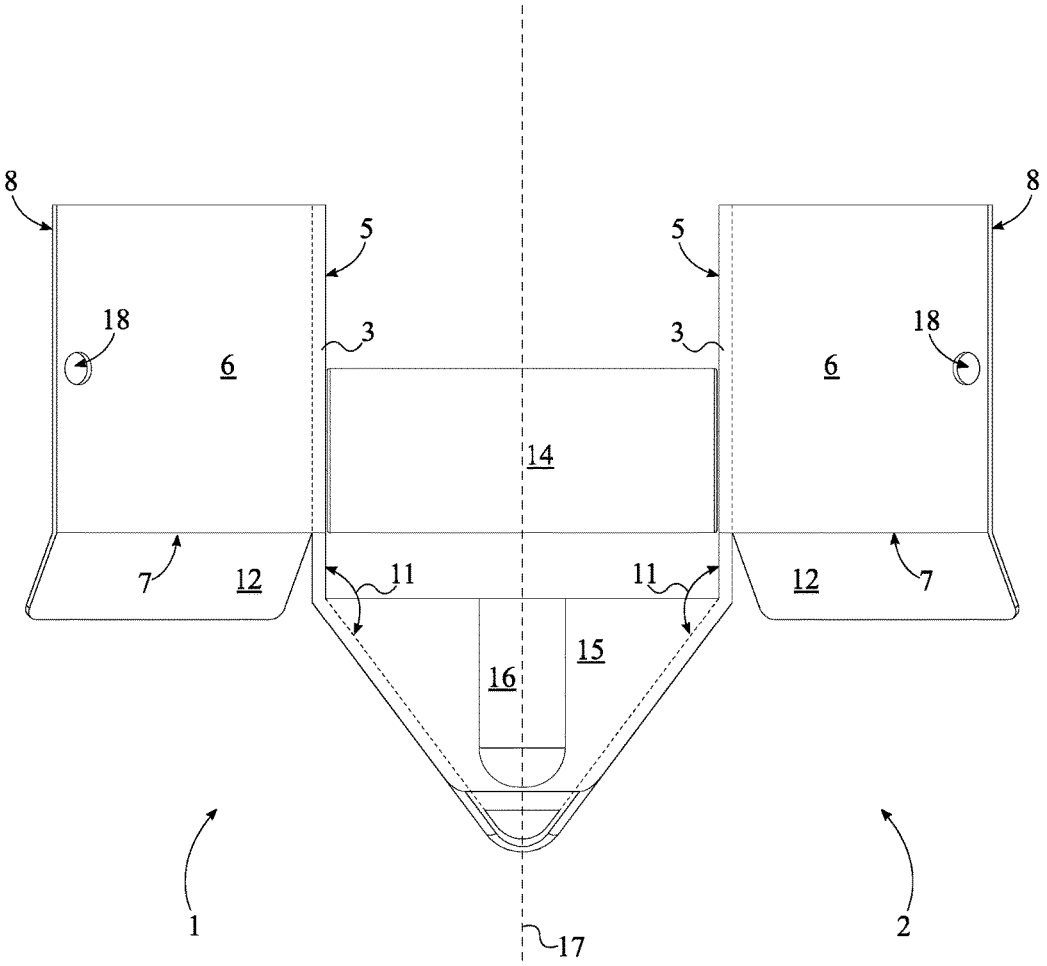
FIG. 3 is a top view of the present invention.

The present invention is mounted to the arm of the boat winch by the clevis 19 as seen in FIG. 4. In particular, the present invention is pivotably mounted to an end of the arm, opposite the boat winch. This positions the present invention partially offset from the deck and side of the watercraft, thus ensuring that the retrieving process the anchor engages the present invention first without potentially scratching the side of the watercraft. The clevis 19 is integrated into the base plate 3 of the first support bracket 1 and the base plate 3 of the second support bracket 2 as seen in FIG. 3. Akin to traditional designs, the clevis 19 comprises a first tab 20, a second tab 21, a mounting hole 22, and a clevis pin 23. The first tab 20 and the second tab 21 serve as the mounting points for the present invention. The first tab 20 is connected adjacent and parallel to the base plate 3 of the first support bracket 1, opposite the wing plate 6 of the first support bracket 1. Similarly, the second tab 21 is connected adjacent and parallel to the base plate 3 of the second support bracket 2, opposite the wing plate 6 of the second support bracket 2. The mounting hole 22 receives the clevis pin 23 and resultantly acts as the pivot axis for the present invention relative to the arm of the boat winch. The mounting hole 22 traverses through the first tab 20 and the second tab 21. The clevis pin 23 traverses through the arm of the boat winch and the mounting hole 22, extending from the first tab 20 to the second tab 21, in order to rotatably mount the present invention to the boat winch.

Referring to FIG. 4 and FIG. 5, during retrieval of the anchor from the water, the anchor is drawn up by the boat winch via an anchor line attached to the return bar of the anchor. The present invention is initially vertically oriented such that the triangular-shaped nose portion is pointed down toward the surface of the body of water. The triangular-shaped nose portion is the first point of contact with the present invention for the anchor during retrieval. In the event that the anchor is drawn into the present invention with the return bar facing towards the present invention, the triangular-shaped nose portion ensures that the return bar is forced to the left or right of the triangular-shaped nose portion, preventing the anchor from entering the area between the first support bracket 1 and the second support bracket 2 on the return bar only. As the anchor is drawn into the present invention, the present invention rotates about the axis of the mounting hole 22 into a horizontal orientation. Simultaneously, the flukes interlock with the wing plate 6 of the first support bracket 1 and the wing plate 6 of the second support bracket 2. The tension force in the anchor line locks the flukes of the anchor to the wing plate 6 of the first support bracket 1 and the wing plate 6 of the second support bracket 2, thus locking the anchor in place.

In the preferred embodiment, the present invention is symmetric in design and further comprises a semi-cylindrical bar 16. A sagittal plane 17 of the first support bracket 1 and the second support bracket 2 divides the present invention into a left side and a right side, wherein the left side is a mirror of the right side. In particular, the first support bracket 1 and the second support bracket 2 are mirrored through the sagittal plane 17 in order to ensure equal support is applied to the anchor from either side, thus increasing the overall stability of the anchor within the present invention. The semi-cylindrical bar 16 serves a similar purpose as the triangular-shaped nose portion and guides the anchor appropriately during the retrieval process. The semi-cylindrical bar 16 is positioned coincident with the sagittal plane 17 and is adjacently connected to the connecting web 15. This ensures that the anchor is oriented properly prior to engaging the wing plate 6 of the first support bracket 1 and the wing plate 6 of the second support bracket 2. The semi-cylindrical bar 16 is important in rotating the anchor during the retrieval process as there are instances where the triangular-shaped nose portion will fail to engage the return bar of the anchor. In these situations, the semi-cylindrical bar 16 pushes the return bar to either the left or right side, ensuring the anchor is properly positioned within the present invention.

In the preferred embodiment, the first support bracket 1 and the second support bracket 2 each further comprise an engagement flange 12 to catch and guide the flukes of the anchor into a secured state, interlocked with the wing plate 6. The engagement flange 12 is an elongated plate that is adjacently connected to the wing plate 6 along a front edge 7 of the wing plate 6. The engagement flange 12 is oriented at a third obtuse angle 24 with the wing plate 6 and is oriented towards the base plate 3 as seen in FIG. 1.

The spool 14 feeds the anchor line that is attached to the anchor through the present invention. Referring to FIG. 1 and FIG. 3, the spool 14 is oriented normal to the base plate 3 of the first support bracket 1 and is positioned in between the base plate 3 of the first support bracket 1 and the base plate 3 of the second support bracket 2. Additionally, the spool 14 is rotatably mounted to the base plate 3 of the first support bracket 1 and the base plate 3 of the second support bracket 2 in order to facilitate the flow of the anchor line during the retrieving process. Furthermore, the spool 14 provides additional vertical support for the anchor when the anchor is positioned and locked in between the first support bracket 1 and the second support bracket 2. The spool 14 may contain a convex surface in order to receive and compliment the contours of the cylindrical body. In the preferred embodiment of the present invention, the spool 14 is rotatably mounted by the clevis 19. More specifically, the spool 14 is positioned concentric with the mounting hole 22 and the clevis pin 23 traverses through the spool 14 as seen in FIG. 1.

In the case that the flukes of the anchor do not engage the wing plate 6, a restraining strap 18 may be used to prevent the anchor from sliding up the winch arm past the present invention and possibly damaging the watercraft. Referring to FIG. 1, in this embodiment, the first support bracket 1 and the second support bracket 2 each further comprise strap hole 13. The strap hole 13 allows the restraining strap 18 to attach to the present invention. In particular, the strap hole 13 normally traverses through the wing plate 6, adjacent to a top edge 8 of the wing plate 6. It is important to position the strap hole 13 close to the top edge 8 of the wing plate 6 so as to prevent the anchor line from rubbing against the restraining strap 18, reducing the lifespan of the restraining strap 18 and the anchor line. The restraining strap 18 traverses through the strap hole 13 of the first support bracket 1 and the strap hole 13 of the second support structure and is drawn taught to be positioned in between the wing plate 6 of the first support bracket 1 and the wing plate 6 of the second support bracket 2.

Although the invention has been explained in relation to its preferred embodiment, it is to be understood that many other possible modifications and variations can be made without departing from the spirit and scope of the invention as hereinafter claimed.

What is claimed is:

1. An anchor cradle for handling and stowing fluke, return bar-type anchors comprises:

a first support bracket;

a second support bracket;

the first support bracket and the second support bracket each comprise a base plate, a wing plate, and a nose plate;

the base plate of the first support bracket being mounted parallel and offset to the base plate of the second support bracket;

the wing plate being adjacently connected to the base plate along a top edge of the base plate;

the wing plate being oriented at a first obtuse angle with the base plate;

the wing plate of the first support bracket and the wing plate of the second support bracket being oriented away from each other;

the nose plate being adjacently connected to the base plate along a front edge of the base plate;

the nose plate being oriented at a second obtuse angle with the base plate;

the nose plate of the first support bracket and the nose plate of the second support bracket being oriented toward each other; and the nose plate of the first support bracket being adjacently connected to the nose plate of the second support bracket.

2. The anchor cradle for handling and stowing fluke, return bar-type anchors as claimed in claim 1 comprises:

a spool;

the spool being oriented normal to the base plate of the first support bracket;

the spool being positioned in between the base plate of the first support bracket and the base plate of the second support bracket; and the spool being rotatably mounted to the base plate of the first support bracket and the base plate of the second support bracket.

3. The anchor cradle for handling and stowing fluke, return bar-type anchors as claimed in claim 1 comprises:

the first support bracket and the second support bracket each further comprise an engagement flange;

the engagement flange adjacently connected to the wing plate along a front edge of the wing plate;

the engagement flange being at a third obtuse angle with the wing plate; and the engagement flange being oriented towards the base plate.

4. The anchor cradle for handling and stowing fluke, return bar-type anchors as claimed in claim 1 comprises:

a connecting web; and the connecting web being connected in between the nose plate of the first support bracket and the nose plate of the second support bracket.

5. The anchor cradle for handling and stowing fluke, return bar-type anchors as claimed in claim 4 comprises:

a semi-cylindrical bar;

a sagittal plane of the first support bracket and the second support bracket;

the first support bracket and the second support bracket being mirrored through the sagittal plane;

the semi-cylindrical bar being positioned coincident with the sagittal plane; and the semi-cylindrical bar being adjacently connected to the connecting web.

6. The anchor cradle for handling and stowing fluke, return bar-type anchors as claimed in claim 1 comprises:

a restraining strap;

the first support bracket and the second support bracket each further comprise a strap hole;

the strap hole normally traversing through the wing plate, adjacent to a top edge of the wing plate;

the restraining strap being positioned in between the wing plate of the first support bracket and the wing plate of the second support bracket; and the restraining strap traversing through the strap hole of the first support bracket and the strap hole of the second support bracket.

7. The anchor cradle for handling and stowing fluke, return bar-type anchors as claimed in claim 1 comprises:

a clevis; and the clevis being integrated into the base plate of the first support bracket and the base plate of the second support bracket.

8. The anchor cradle for handling and stowing fluke, return bar-type anchors as claimed in claim 7 comprises:

the clevis comprises a first tab, a second tab, a mounting hole, and a clevis pin;

the first tab being connected adjacent and parallel to the base plate of the first support bracket, opposite of the wing plate of the first support bracket;

the second tab being connected adjacent and parallel to the base plate of the second support bracket, opposite of the wing plate of the second support bracket;

the mounting hole traversing through the first tab and the second tab; and the clevis pin being positioned within the mounting hole, extending from the first tab to the second tab.

9. An anchor cradle for handling and stowing fluke, return bar-type anchors comprises:

a first support bracket;

a second support bracket;

the first support bracket and the second support bracket each comprise a base plate, a wing plate, a nose plate, and an engagement flange;

the base plate of the first support bracket being mounted parallel and offset to the base plate of the second support bracket;

the wing plate being adjacently connected to the base plate along a top edge of the base plate;

the wing plate being oriented at a first obtuse angle with the base plate;

the wing plate of the first support bracket and the wing plate of the second support bracket being oriented away from each other;

the nose plate being adjacently connected to the base plate along a front edge of the base plate;

the nose plate being oriented at a second obtuse angle with the base plate;

the nose plate of the first support bracket and the nose plate of the second support bracket being oriented toward each other;

the nose plate of the first support bracket being adjacently connected to the nose plate of the second support bracket;

the engagement flange adjacently connected to the wing plate along a front edge of the wing plate;

the engagement flange being at a third obtuse angle with the wing plate; and the engagement flange being oriented towards the base plate.

10. The anchor cradle for handling and stowing fluke, return bar-type anchors as claimed in claim 9 comprises:

a spool;

the spool being oriented normal to the base plate of the first support bracket;

the spool being positioned in between the base plate of the first support bracket and the base plate of the second support bracket; and the spool being rotatably mounted to the base plate of the first support bracket and the base plate of the second support bracket.

11. The anchor cradle for handling and stowing fluke, return bar-type anchors as claimed in claim 9 comprises:

a connecting web; and the connecting web being connected in between the nose plate of the first support bracket and the nose plate of the second support bracket.

12. The anchor cradle for handling and stowing fluke, return bar-type anchors as claimed in claim 11 comprises:

a semi-cylindrical bar;

a sagittal plane of the first support bracket and the second support bracket;

the first support bracket and the second support bracket being mirrored through the sagittal plane;

the semi-cylindrical bar being positioned coincident with the sagittal plane; and the semi-cylindrical bar being adjacently connected to the connecting web.

13. The anchor cradle for handling and stowing fluke, return bar-type anchors as claimed in claim 9 comprises:

a restraining strap;

the first support bracket and the second support bracket each further comprise a strap hole;

the strap hole normally traversing through the wing plate, adjacent to a top edge of the wing plate;

the restraining strap being positioned in between the wing plate of the first support bracket and the wing plate of the second support bracket; and the restraining strap traversing through the strap hole of the first support bracket and the strap hole of the second support bracket.

14. The anchor cradle for handling and stowing fluke, return bar-type anchors as claimed in claim 9 comprises:

a clevis; and the clevis being integrated into the base plate of the first support bracket and the base plate of the second support bracket.

15. The anchor cradle for handling and stowing fluke, return bar-type anchors as claimed in claim 14 comprises:

the clevis comprises a first tab, a second tab, a mounting hole, and a clevis pin;

the first tab being connected adjacent and parallel to the base plate of the first support bracket, opposite of the wing plate of the first support bracket;

the second tab being connected adjacent and parallel to the base plate of the second support bracket, opposite of the wing plate of the second support bracket;

the mounting hole traversing through the first tab and the second tab; and the clevis pin being positioned within the mounting hole, extending from the first tab to the second tab.

* * * * *